US008561855B2

(12) United States Patent
Hennen et al.

(10) Patent No.: US 8,561,855 B2
(45) Date of Patent: Oct. 22, 2013

(54) HIGH-VOLUME FLUID DISPENSE SYSTEM

(75) Inventors: John M. Hennen, Carver, MN (US); Barry L. Rauworth, Young America, MN (US); James C. Linder, Shorewood, MN (US)

(73) Assignee: Entegris, Inc., Billerica, MA (US)

( * ) Notice: Subject to any disclaimer, the term of this patent is extended or adjusted under 35 U.S.C. 154(b) by 1112 days.

(21) Appl. No.: 11/400,034

(22) Filed: Apr. 7, 2006

(65) Prior Publication Data

US 2006/0243755 A1 Nov. 2, 2006

Related U.S. Application Data

(60) Provisional application No. 60/669,945, filed on Apr. 8, 2005.

(51) Int. Cl.
*B67D 7/78* (2010.01)

(52) U.S. Cl.
USPC ..... 222/400.7; 222/1; 222/464.1; 222/318; 222/424

(58) Field of Classification Search
USPC ..... 222/400.7, 464.1, 542, 1, 318, 424; 137/212, 588, 320, 322, 215
See application file for complete search history.

(56) References Cited

U.S. PATENT DOCUMENTS

| | | | | |
|---|---|---|---|---|
| 655,672 | A | | 8/1900 | Engel |
| 665,252 | A | | 1/1901 | Morawetz |
| 729,145 | A | | 5/1903 | Eckenwiler |
| 2,150,673 | A | * | 3/1939 | De Steffan ..... 62/399 |
| 2,187,389 | A | | 1/1940 | Winkler |
| 3,035,603 | A | | 5/1962 | Jamieson et al. |
| 3,065,885 | A | | 11/1962 | Chatten |
| 3,361,152 | A | | 1/1968 | Akers |
| 3,670,929 | A | | 6/1972 | Berry |
| 3,720,355 | A | | 3/1973 | Johnston |
| 3,743,145 | A | | 7/1973 | Johnston |
| 3,758,008 | A | * | 9/1973 | Johnston ..... 222/400.7 |
| 3,774,820 | A | | 11/1973 | Zucconi |
| 3,776,260 | A | | 12/1973 | Ruddick |
| 3,868,049 | A | | 2/1975 | Johnston |
| 3,891,118 | A | | 6/1975 | Laurizio |
| 4,089,444 | A | | 5/1978 | Shea |
| 4,093,124 | A | | 6/1978 | Morane et al. |
| 4,114,779 | A | | 9/1978 | Stoll, III |

(Continued)

FOREIGN PATENT DOCUMENTS

| | | |
|---|---|---|
| JP | 2005-508730 | 4/2005 |
| WO | WO 03/006359 A2 | 1/2003 |

*Primary Examiner* — J. Casimer Jacyna
(74) *Attorney, Agent, or Firm* — Christensen Fonder P.A.

(57) ABSTRACT

A fluid dispense system for use with a drum having a drum insert configured to couple with a bung included on a drum, the drum insert having an upper portion and a drum insert down tube extending therefrom into an interior of the drum. The system further having a dispense head configured to couple with the drum insert, the dispense head having first and second conduits, each having a valve assembly, the valve assemblies in operable communication with the drum insert when the dispense head is coupled with the drum insert. When the dispense head is coupled with the drum insert the first and second valve assemblies are effected to an open position enabling fluid to flow through the conduits. When the dispense head is not coupled with the drum insert the first and second valve assemblies are biased to a closed position inhibiting fluid from flowing through the conduits.

22 Claims, 12 Drawing Sheets

(56) References Cited

U.S. PATENT DOCUMENTS

| | | | |
|---|---|---|---|
| 4,134,522 | A | 1/1979 | Patzke et al. |
| 4,212,414 | A | 7/1980 | Beyens |
| 4,231,489 | A | 11/1980 | Malone |
| 4,625,889 | A | 12/1986 | Baughman |
| 4,643,825 | A | 2/1987 | Weslowski |
| 4,699,298 | A | 10/1987 | Grant et al. |
| 4,732,414 | A | 3/1988 | Inaba |
| 4,832,237 | A | 5/1989 | Hurford, Jr. |
| 4,929,293 | A | 5/1990 | Osgar |
| 4,972,568 | A | 11/1990 | Schurr |
| 4,979,545 | A | 12/1990 | Fair |
| 4,984,717 | A | 1/1991 | Burton |
| 5,102,010 | A | 4/1992 | Osgar et al. |
| 5,108,015 | A | 4/1992 | Rauworth et al. |
| 5,118,015 | A | 6/1992 | Scholle et al. |
| 5,121,857 | A | 6/1992 | Hutchinson |
| 5,199,613 | A | 4/1993 | Magrath et al. |
| 5,204,499 | A | 4/1993 | Favalora |
| 5,299,608 | A | 4/1994 | Bosyj |
| 5,335,821 | A | 8/1994 | Osgar |
| 5,413,240 | A | 5/1995 | Hunter et al. |
| 5,511,692 | A | 4/1996 | Willingham |
| 5,526,956 | A | 6/1996 | Osgar |
| 5,636,769 | A | 6/1997 | Willingham |
| 5,667,253 | A | 9/1997 | Jansen et al. |
| 5,878,924 | A | 3/1999 | Johnson |
| 5,957,328 | A | 9/1999 | Osgar |
| 5,975,379 | A | 11/1999 | Johnson |
| 6,007,107 | A | 12/1999 | Kazarian |
| 6,015,068 | A | 1/2000 | Osgar et al. |
| 6,021,802 | A | 2/2000 | Leifels et al. |
| 6,045,000 | A | 4/2000 | Rauworth et al. |
| 6,079,597 | A | 6/2000 | Rauworth et al. |
| 6,425,502 | B1 | 7/2002 | Rauworth et al. |
| 6,499,719 | B1 | 12/2002 | Clancy et al. |
| 6,523,861 | B1 | 2/2003 | Clancy et al. |
| 6,568,427 | B2 | 5/2003 | Imai |
| RE38,204 | E | 7/2003 | Kazarian |
| 6,669,062 | B1 | 12/2003 | Laible |
| 6,739,577 | B2 | 5/2004 | Clancy et al. |
| 6,840,464 | B2 | 1/2005 | Engelbrecht et al. |
| 2002/0050494 | A1 | 5/2002 | Rauworth et al. |
| 2002/0092582 | A1 | 7/2002 | Hennan et al. |
| 2003/0010307 | A1 | 1/2003 | Truglio |
| 2003/0010387 | A1 | 1/2003 | Rauworth et al. |

* cited by examiner

HIGH-VOLUME FLUID DISPENSE SYSTEM

RELATED APPLICATION

The present application claims the benefit of U.S. Provisional Application No. 60/669,945, filed Apr. 8, 2005, which is incorporated herein in its entirety by reference.

FIELD OF THE INVENTION

This invention relates generally to fluid dispense systems. More particularly, the invention relates to dispense head and drum insert assemblies for use with caustic and high purity fluid containers.

BACKGROUND OF THE INVENTION

High purity and highly corrosive liquids are often utilized in industries such as semiconductor processing and chemical manufacturing. Due to quality and safety concerns, these liquids generally must be contained in high integrity containers and dispensed using highly reliable dispensing systems.

Conventionally, the containers are drums formed of high purity polyethylene, such as those described in U.S. Pat. No. 6,045,000. Examples of dispensing systems suitable for use with these drums are described in U.S. Pat. Nos. 4,699,298, 5,108,015, 5,957,328, and 5,526,956. The connections, tubing, and fittings for handling these fluids are often formed from inert materials, such as various fluoropolymers. The tubing is commonly formed of Per Fluor Alkoxy ("PFA"), while the fittings and valve components can be formed of components such as PFA, Poly Tetra Fluoro Ethylene ("PTFE"), and other various fluoropolymers.

Conventional drums often include a bung opening and a drum insert connected to an upward and concentric nipple on the bung. A dispense head can be operably coupled with the drum insert and can include a main fluid passageway that connects to and sealingly engages the bung.

In many applications, the fluid that is dispensed from the drum can later be recirculated to the drum. This has been accomplished by using a recirculation passageway in the dispense head. However, these recirculation passageways can be uncontrolled and thus can remain in an open position when the dispense head is not connected to the drum, which can create a potential for spillage.

Also, recirculated fluid can create foam that can cause problems, such as foam entry into the vent lines, potential clogging, contamination of normally dry areas of the dispense head and gas refill line, and difficulty in emptying a drum with low levels of fluid. The foam can be created when fluid is recirculated into the dispense head and further when recirculated fluid is dispensed into the drum.

When using dispense heads to draw high purity, highly corrosive, and highly caustic liquids from drums, it can be important not to connect a dispense head for equipment requiring one type of liquid to a drum containing an incorrect or incompatible different liquid. To inhibit this, coded indexing sections and recesses have been provided in the dispense head and drum insert to enable assembly of the drum insert to the dispense head only when the correct coding exists. However, connecting a coded dispense head to a coded drum insert can require a great amount of force while turning the coding and holding down the dispense head. This process can involve a two-step operation of holding down the dispense head with one hand while rotating the code key with the other.

SUMMARY OF THE INVENTION

The fluid dispense system of the present invention provides a valve within the main fluid and recirculation passageways to automatically cut off the flow in the passageways when the dispense head is removed from the drum. The main fluid and recirculation passageways through the dispense head can be controlled by these valve assemblies, which can open when the dispense head is operably coupled with the drum insert and close when the dispense head is removed from the drum insert.

In addition, the fluid dispense system of the present invention decreases the amount of foam created during the recirculation of surfactant fluid into the dispense head and drum. The dispense head can include a recirculated fluid conduit that discharges recirculated fluid into the annular space around the drum insert down tube. A foam reduction diffuser can further reduce or eliminate foam that can be created during this recirculation process.

The fluid dispense system of the present invention also eases connection of a coded dispense head to a coded drum insert can by including a coupling assembly and method for quickly and easily coupling the dispense head to a drum insert.

In an aspect, the present invention relates to a fluid dispense system for use with a drum comprising a drum insert configured to operably couple with a bung included on a drum, the drum insert having an upper portion and a drum insert down tube extending therefrom into an interior of the drum and a dispense head configured to operably couple with the drum insert, the dispense head having a first conduit comprising a first valve assembly and a second conduit comprising a second valve assembly, the first and second valve assemblies in operable communication with the drum insert when the dispense head is operably coupled with the drum insert, such that when the dispense head is operably coupled with the drum insert the first and second valve assemblies can be effected to an open position enabling fluid to flow through the conduits, and when the dispense head is not operably coupled with the drum insert the first and second valve assemblies can be biased to a closed position inhibiting fluid from flowing through the conduits.

The second valve assembly can comprise a poppet valve including a poppet member and a biasing member to bias the poppet member to the closed position. The drum insert can comprise an actuation rib effecting the poppet valve to the open position when the dispense head is operably coupled with the drum insert.

The second conduit can comprise a recirculation fluid conduit enabling fluid to be returned to the interior of the drum through the recirculation fluid conduit. The first fluid conduit can comprise a main fluid conduit in fluid communication with a tube conduit included in the drum insert down tube and the recirculation fluid conduit can be in fluid communication with a media return conduit defined by the drum insert down tube and a diffuser down tube, the diffuser down tube further comprising a deflector proximate a lower end thereof.

A foaming reduction member can be included on the diffuser to reduce foaming of recirculated fluid prior to returning to the drum through the recirculation fluid conduit. The foaming reduction member can comprise a foam reduction chamber such that gas can be separated from the recirculated fluid and the gas can be vented from the chamber and the fluid flows out of the chamber and through the media return conduit.

The dispense head can further comprise a vent conduit enabling gas to enter and leave the drum through the vent conduit and a seal verification conduit in fluid communication with an aperture intermediate two seals at a junction between the operably coupled dispense head and drum insert.

In another aspect, the present invention relates to a method of using a fluid dispense system for use with a drum comprising inserting a drum insert into an access opening of a drum such that a drum insert down tube of the drum insert extends into an interior of the drum, operably coupling an upper portion of the drum insert with the access opening of the drum, providing a dispense head having a first conduit comprising a first valve assembly and a second conduit comprising a second valve assembly, and operably coupling the dispense head to the drum insert such that the first and second valve assemblies can be effected into an open position enabling fluid to flow through the respective first and second conduits.

Fluid can be directed out of the drum via the first conduit when the first valve assembly is in the open position and returned to the drum via the second conduit when the second valve assembly is in the open position.

A foaming reduction member can be provided within the drum insert, the foam reduction member having a foam reduction chamber, such that gas can be separated from recirculated fluid in the foam reduction chamber. Gas can be vented from the foam reduction chamber and liquid enabled to flow out of the foam reduction chamber to an interior of the drum. A vent conduit can be provided on the on the dispense head enabling gas to enter and leave the drum through the vent conduit. A seal verification conduit can be provided on the dispense head, the seal verification conduit in fluid communication with an aperture intermediate two seals positioned at a junction between the dispense head and the drum insert, such that the seal verification conduit can be used to verify an integrity of the seals.

In a further aspect, the present invention relates to a coupling assembly for coupling a dispense head to a drum insert for use in a fluid dispense system, the coupling assembly comprising a retaining ring having a plurality of detents disposed on an inner surface thereof and a collar having a code ring disposed thereon, the retaining ring and collar independently rotatable when the coupling assembly is not in engageable communication with the drum insert, the collar further comprising an internal flange having a flange surface and a plurality of engagement members displaceable between a biased position below the flange surface and an engagement position above the flange surface, and wherein when the coupling assembly is placed into engageable communication with the drum insert, the engagement members can be displaced to the engagement position and engageable with the detents, such that the collar can be rotatably with retaining ring to selectively align the code ring with a coded section disposed on the drum insert.

The coupling assembly can include a first threaded portion on the inner surface of the retaining ring and a second threaded portion on an external surface of the drum insert such that the coupling assembly can be selectively coupled with the drum insert by threading the first threaded portion with the second threaded portion. The coupling assembly can further include a snap member disposed on the collar and a snap receiving notch disposed on the code ring, the code ring and collar selectively engageable by engaging the snap member and snap receiving notch. The retaining ring, collar, and code ring can be constructed of high-density polyethylene (HDPE).

In yet another aspect, the present invention relates to a method of coupling a dispense head to a drum insert in a fluid dispense system comprising providing a coupling assembly comprising a retaining ring having a plurality of detents disposed on an inner surface thereof and a collar having a code ring operably coupled thereto, operably coupling the retaining ring to the dispense head, operably coupling the collar to the dispense head, the collar further comprising an internal flange having a flange surface and a plurality of engagement members movable between a biased position below the flange surface and an engagement position above the flange surface, such that the retaining ring and collar can be independently rotatable when the coupling assembly is not in engageable communication with the drum insert, placing at least a portion of the coupling assembly into communication with the drum insert, effecting a force on the coupling assembly such that the engagement members can be displaced to the engagement position and engage with the detents, such that the collar can be rotatable dependent of the retaining ring, rotating the retaining ring to selectively align the code ring with a coded section disposed on the upper portion of the drum insert, and operably coupling the coupling assembly with the drum insert.

First indicia can be provided on the code ring and second indicia can be included on the coded section on the drum insert, such that step of rotating the retaining ring to selectively align the code ring with the coded section can comprise matching the first indicia with the second indicia.

In another aspect, the present invention relates to a method of reducing foaming while recirculating fluid into a drum through a dispense head, the method comprising inserting a drum insert having a down tube extending therefrom into an access opening of a drum such that the drum insert down tube of the drum insert extends into an interior of the drum, operably coupling an upper portion of the drum insert with the access opening of the drum, operably coupling the dispense head with the upper portion of the drum insert, the dispense head including a main fluid conduit and a recirculation fluid conduit in the dispense head, the main fluid conduit in fluid communication with an interior surface of the drum insert down tube and the recirculation fluid conduit in communication with a media return conduit defined by an external surface of the drum insert down tube and a diffuser down tube, the diffuser down tube comprising a deflector at a lower end thereof, and recirculating fluid into the drum through the recirculation fluid conduit into the media return conduit, such that the recirculating fluid passes over the deflector, the deflector reducing foaming of fluid returning to the drum.

The method can further include recirculating fluid through a foam reduction chamber disposed proximate an upper end of the diffuser down tube, the foam reduction chamber separating gas from fluid and discharging the gas through vents that can be connected to a venting port included on the dispense head, while the recirculating fluid flows downwardly through the media return conduit. The deflector can be positioned below the liquid level of fluid in the drum.

In a further aspect, the present invention relates to a fluid dispense system for use with a drum comprising a drum insert configured to couple an access opening of a drum, the drum insert having an upper portion and a drum insert down tube extending therefrom into an interior of the drum and a dispense head comprising means for coupling the dispense head to the drum insert, the dispense head having a first fluid conduit comprising a first valve means and a second conduit comprising a second valve means, the first and second valve means in communication with the drum insert when the dispense head is operably coupled with the drum insert, such that when the dispense head is operably coupled with the drum insert the first and second valve means can be in an open position enabling fluid to flow through the conduits, and when the dispense head is not operably coupled with the drum insert the first and second valve means can be biased to a closed position inhibiting fluid from flowing through the conduits.

In yet another aspect, the present invention relates to a fluid dispense system for use with a drum comprising a drum insert configured to couple a bung included on a drum, the drum insert having an upper portion and a drum insert down tube extending therefrom into an interior of the drum and a dispense head configured to couple the drum insert, the dispense head having a first fluid conduit comprising a first valve assembly and a seal verification port in fluid communication with a seal verification conduit and an aperture intermediate two seals at a junction between the dispense head and the drum insert, the aperture being substantially transverse the seal verification conduit, such that an integrity of a sealing between the dispense head and drum insert can be verified by forcing air into the seal verification port. The two seals can be O-rings, which can be encapsulated with polytetrafluoroethylene (PTFE).

DETAILED DESCRIPTION OF THE DRAWINGS

Figure 1:
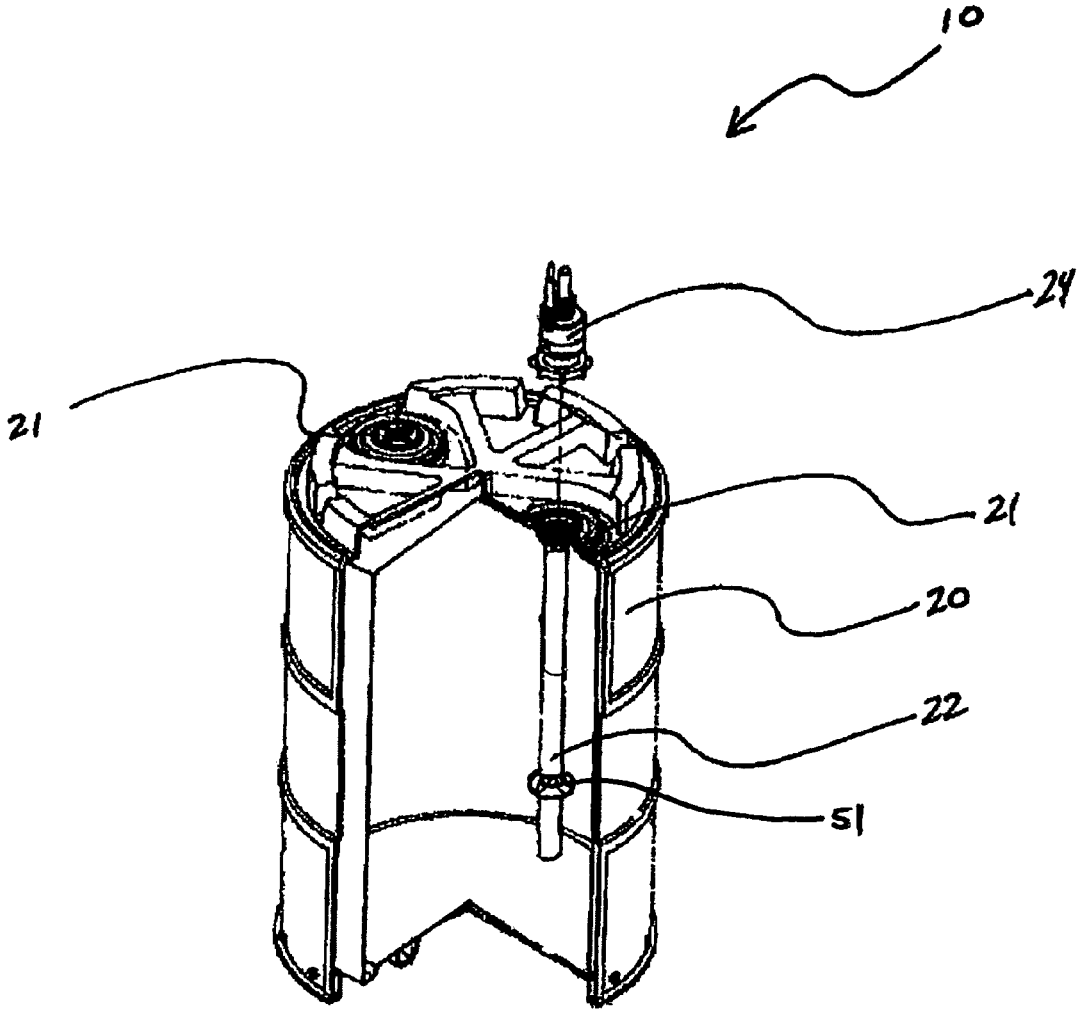
FIG. 1 is a perspective cutaway view of a fluid dispense system of the present invention.

Referring to FIG. 1, a fluid dispense system 10 of the present invention broadly includes a drum 20 having one or more access openings or bungs 21 defined therein, a drum insert 22 operably coupled with the bung 21, and a dispense head 24 selectively coupleable with the drum insert 22.

The drum 20 can be constructed of single or multiple layers, such as polymer layers, and can be formed in a blow molding process. While the drum can be constructed of a blow molded polymer, such as blow molded polyethylene, those skilled in the art will recognize that other polymer materials and forming processes can be used. Examples of drums 20 that can be employed with the various embodiments of the present invention are disclosed in U.S. Pat. No. 6,045,000 and U.S. Patent Application Publication No. 2002/0050494, both of which are incorporated herein by reference.

Figure 2:
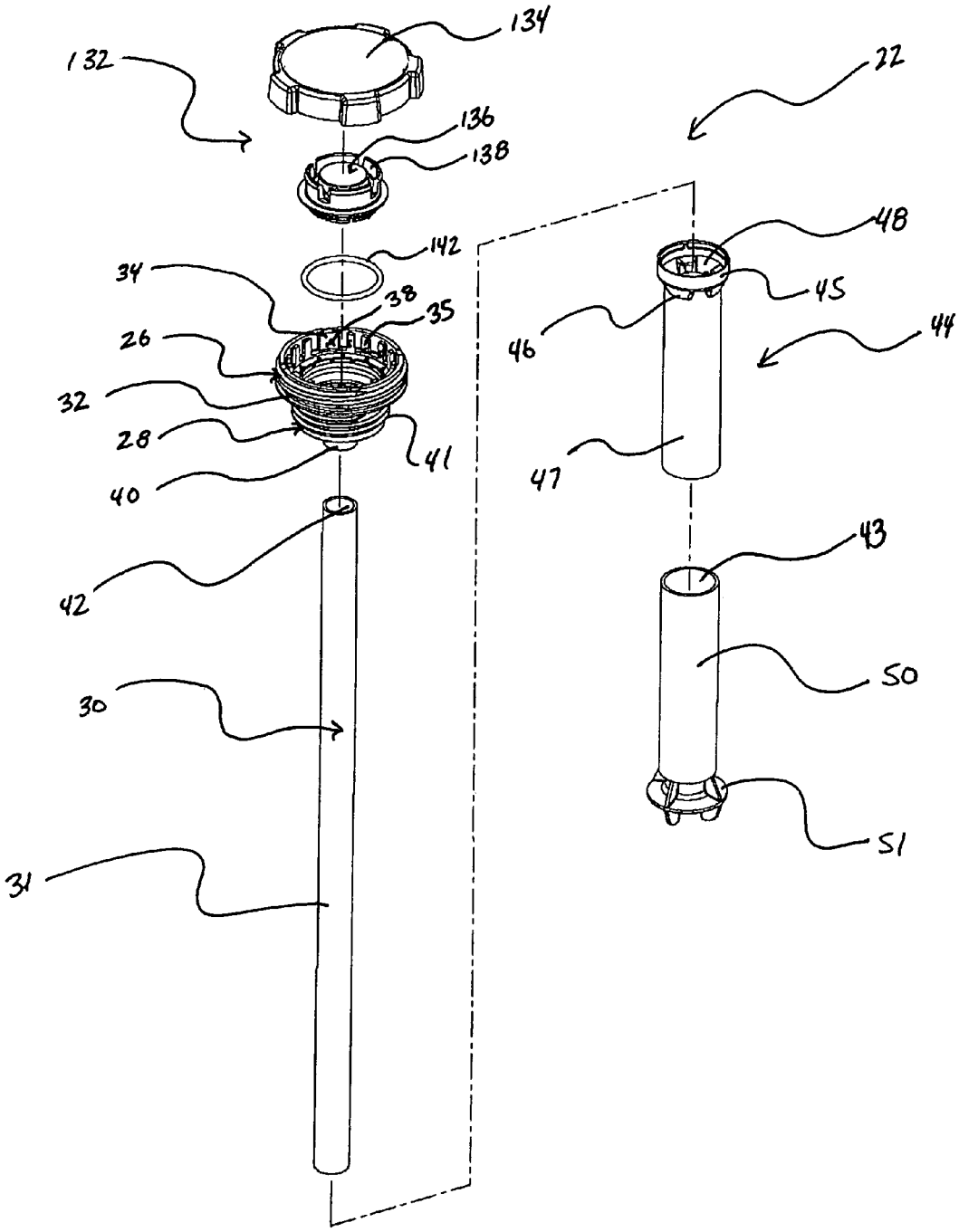
FIG. 2 is an exploded view of a drum insert and a cap assembly according to the present invention.
Figure 3:
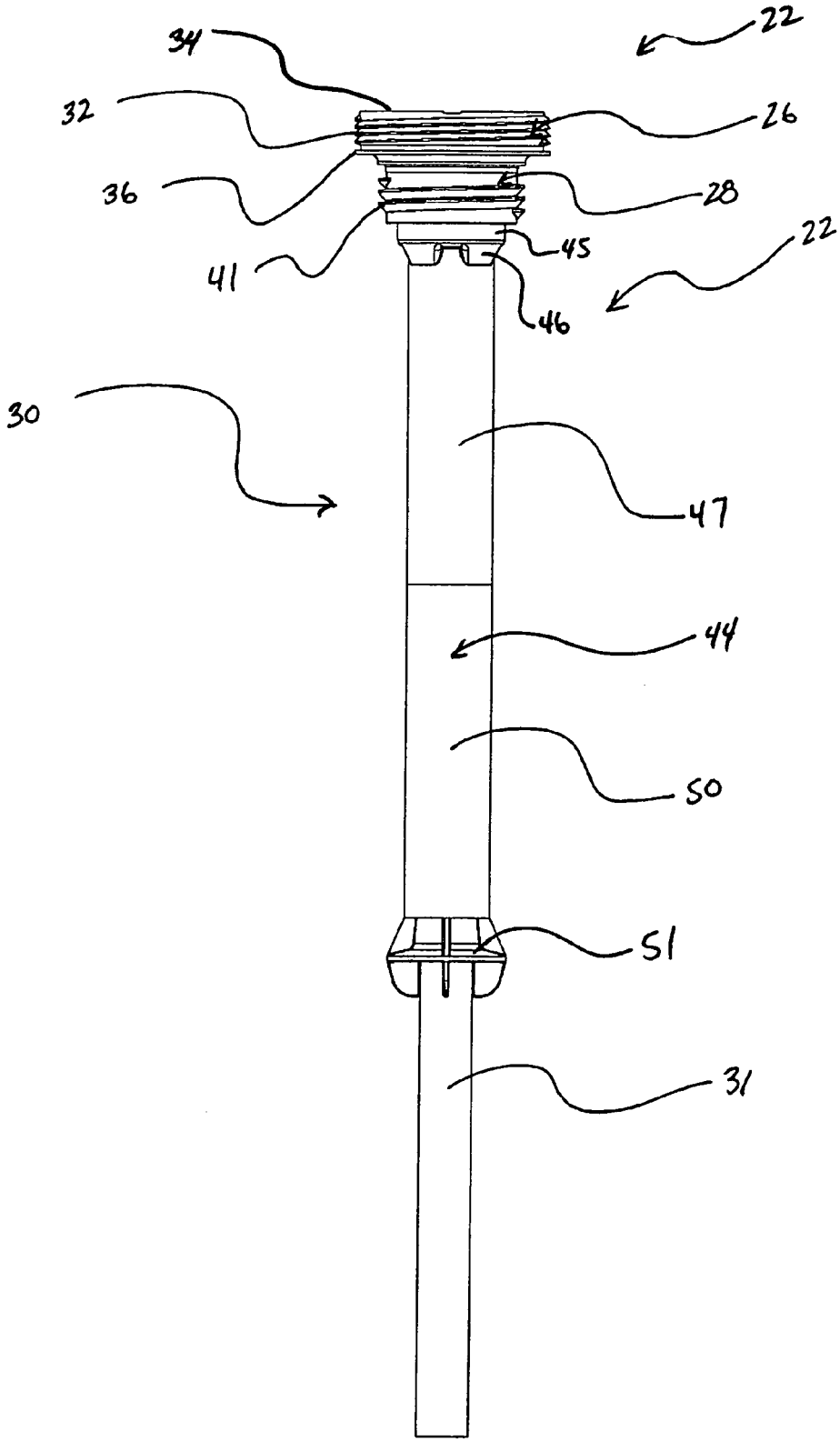
FIG. 3 is an elevational view of the drum insert of FIG. 2.

Referring to FIGS. 2-3, the drum insert 22 generally includes an upper or nipple portion 26, an intermediate body portion 28 operably coupled or integrally formed with the upper portion 26, and a lower down tube portion 30 extending from the intermediate body portion 28. Referring to FIGS. 2-5, the upper portion 26 can include a cap thread portion 32 and a recess 34 forming an interior surface of the upper portion 26. Referring to FIG. 2, the cap thread portion 32 can be used to operably couple a cap assembly 132 to the drum insert 22 that can be used when transporting or storing the drum 20.

Figure 4:
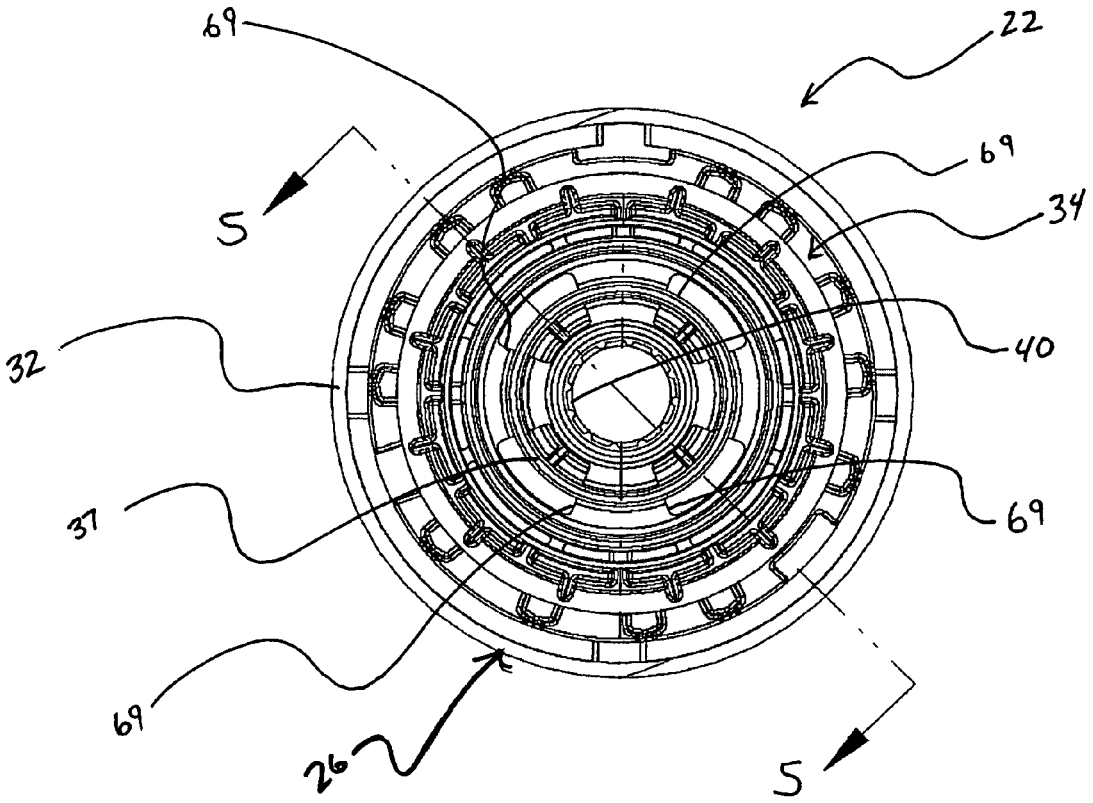
FIG. 4 is a top plan view of the drum insert of FIG. 2.
Figure 5:
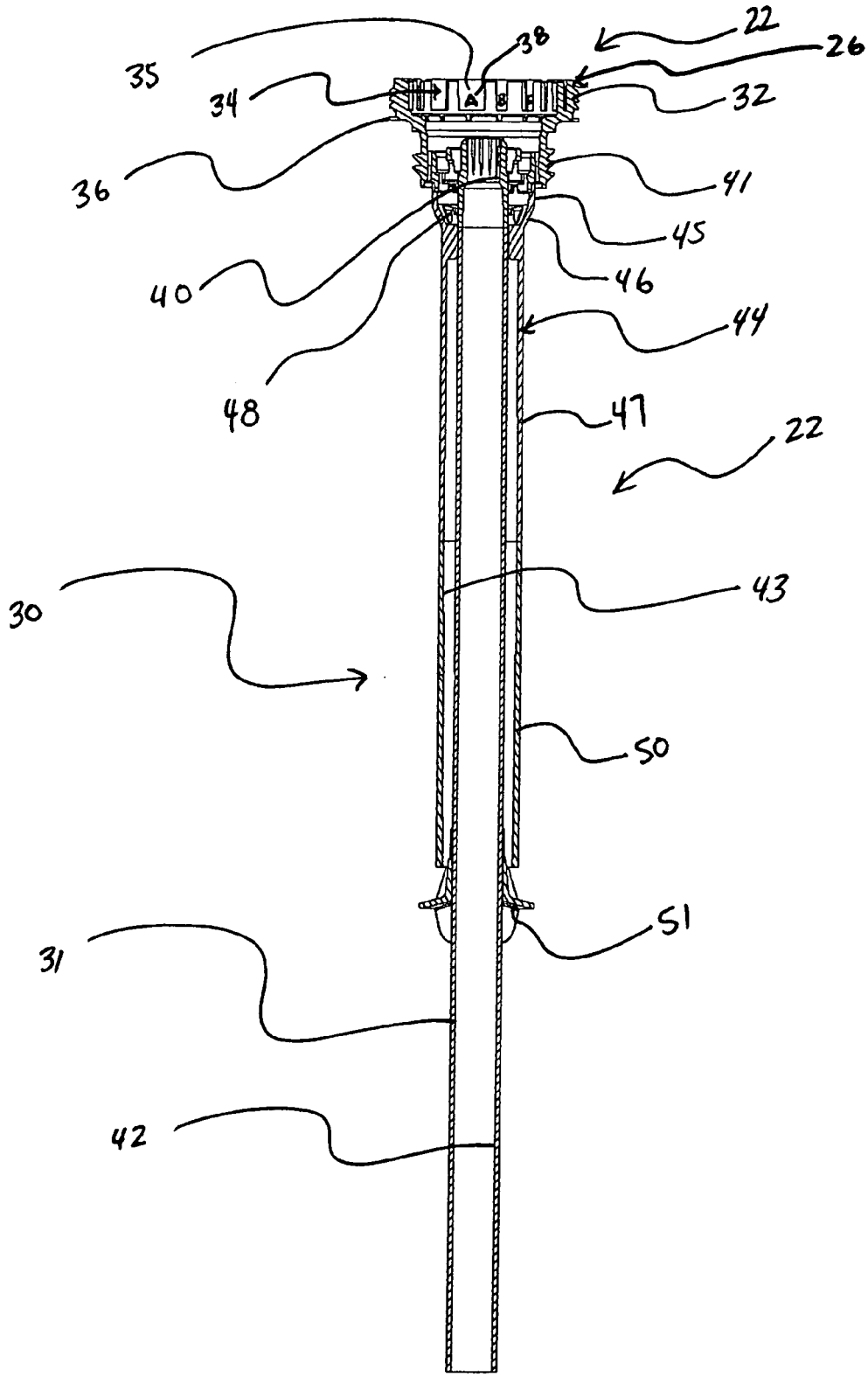
FIG. 5 is a cross sectional view of the drum insert of FIG. 4 taken along line 5-5.
Figure 8:
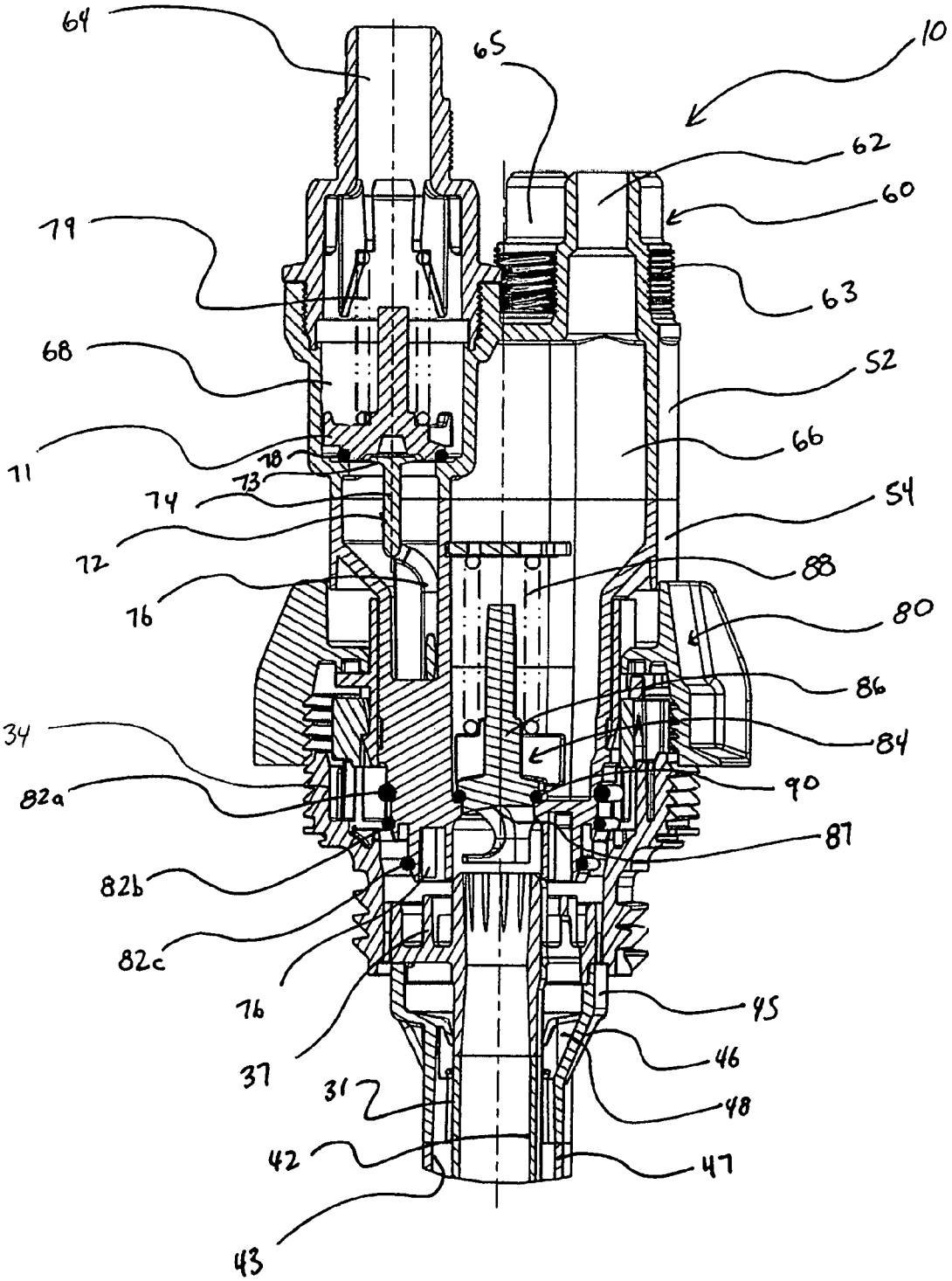
FIG. 8 is a cross sectional view of the dispense head of FIG. 7 taken along line 8/9-8/9 prior to being operably coupled with the drum insert of FIG. 2, depicting the poppet valves associated with the main fluid and recirculation passageways in a closed position.
Figure 9:
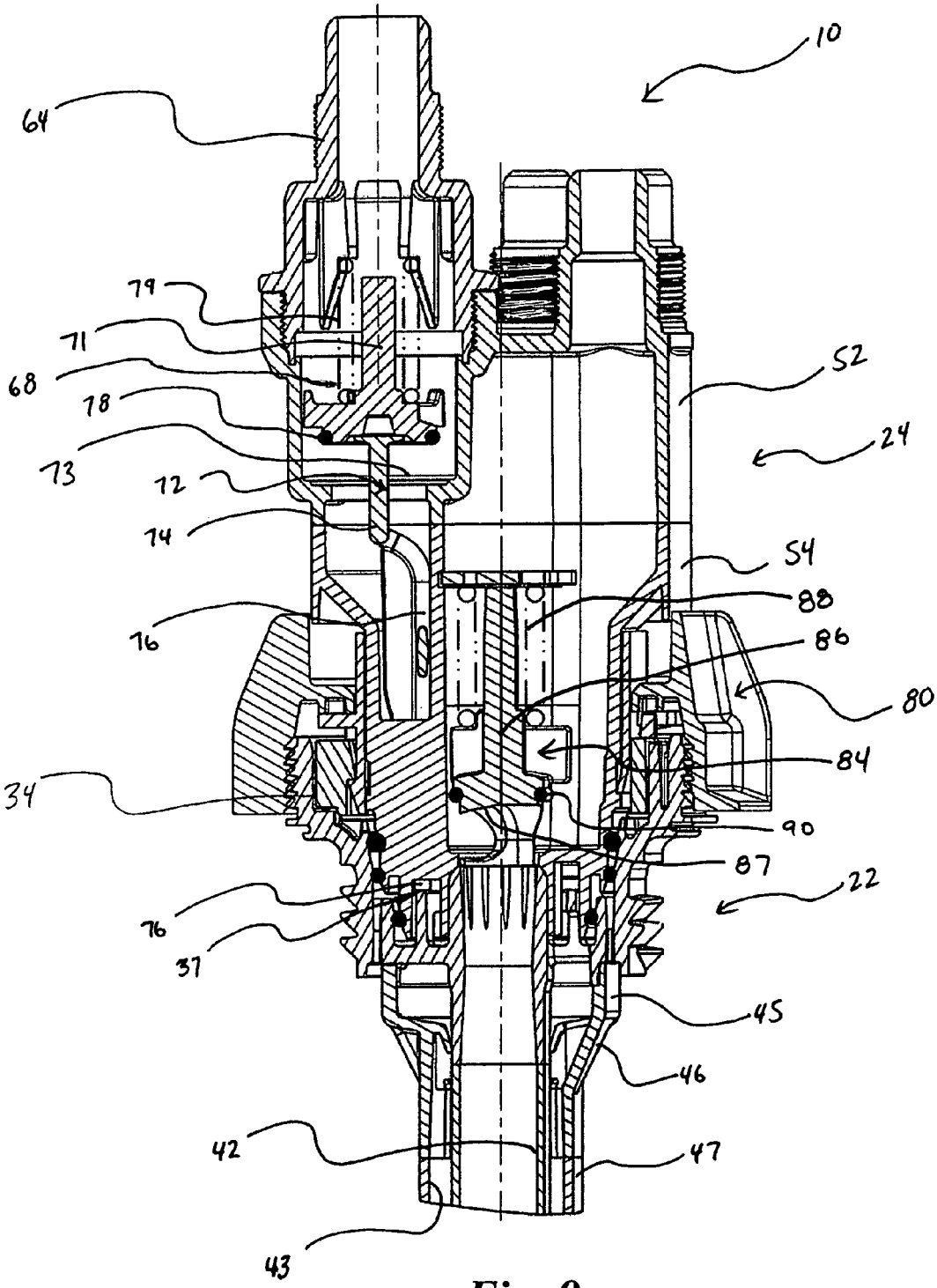
FIG. 9 is a cross sectional view of the dispense head of FIG. 7 taken along line 8/9-8/9 after being operably coupled with the drum insert of FIG. 2, depicting the poppet valves associated with the main fluid and recirculation passageways in an open position.
Figure 12:
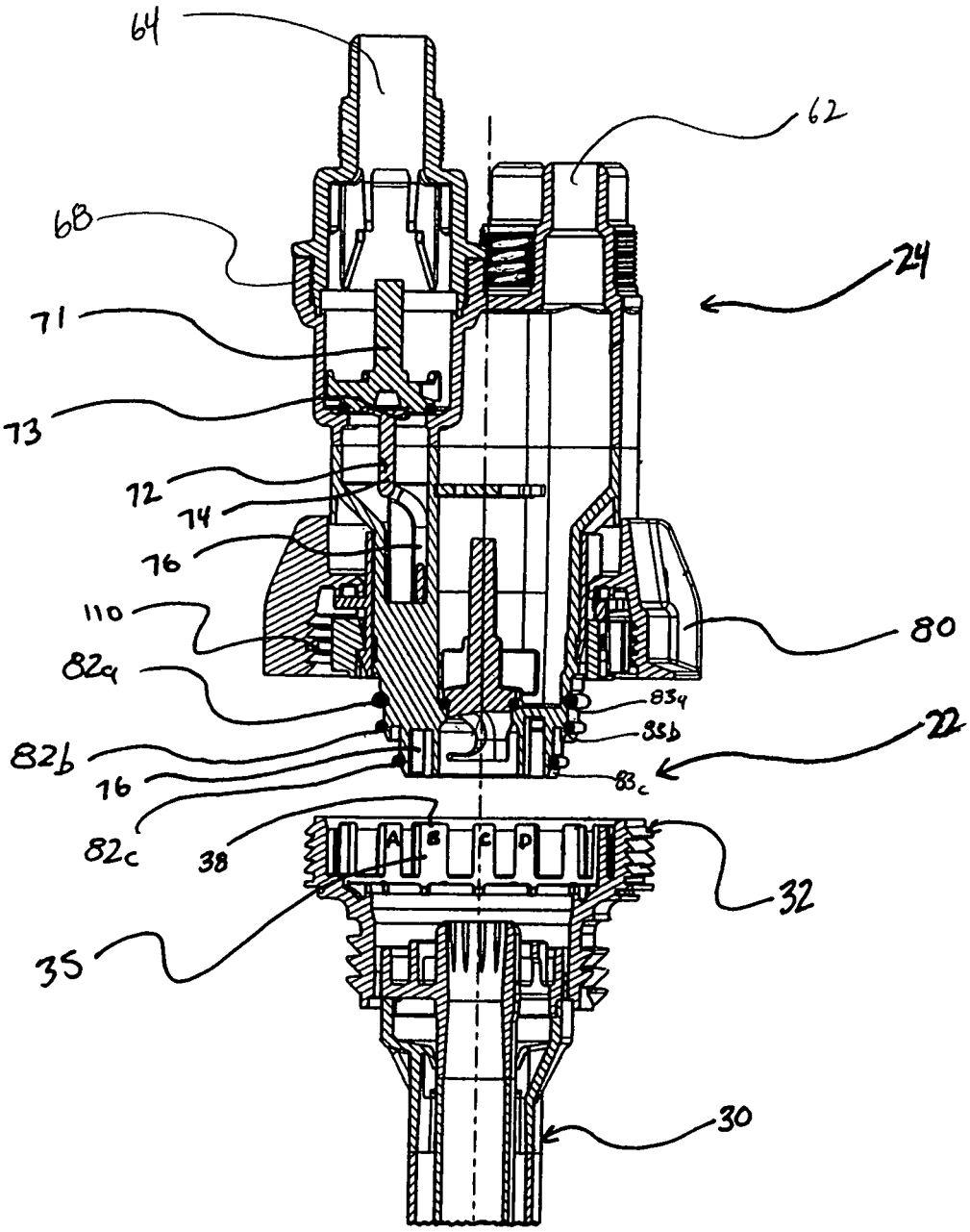
FIG. 12 is a cross sectional view of the dispense head of FIG. 6 prior to being operably coupled with the drum insert of FIG. 2.

Referring to FIGS. 4, 8, and 9, an actuation rib 37 can be included within the recess 34 and can be used to actuate a poppet valve via a poppet valve stem, as will be described in greater detail herein. Referring to FIGS. 2, 5, and 12, a plurality of coded sections 35 can also be included within the recess to inhibit equipment from being used in conjunction with an incorrect or incompatible chemical or liquid. Alternatively, the coded sections can be positioned on a top surface of the recess. The coded sections 35 can include indicia 38 thereon. Further included on the upper portion 26 can be a peripheral flange 36 that can be used to operably couple an identification tag thereto.

Referring again to FIGS. 2 and 5, the intermediate body portion 28 includes an intermediate conduit 40 extending therefrom in fluid communication with the recess 34 enabling dispensed fluid to move between the drum 20 and dispense head 24 and vice versa. The intermediate body portion 28 can further include bung threading 41 that can be used operably couple the drum insert 22 to the access opening or bung 21 on a drum 20.

Referring to FIGS. 2 and 3, the lower down tube portion 30 generally includes a down tube 31 and a diffuser 44 operably or integrally coupled thereto. Referring to FIG. 3, the down tube can include a tube conduit 42 in fluid communication with the intermediate conduit 40 and recess 34, thus enabling dispensed fluid to move between the drum 20 and dispense head 24 and vice versa.

Referring to FIG. 5, the diffuser 44 can include a foam reduction chamber 48 proximate an end thereof defined by a wall portion 45 and a funnel portion 46 and an upper diffuser down tube 47 on an upper end of the diffuser 44. The diffuser 44 can be bonded to the down tube 31 by known methodologies, such as polymer welding. The outside surface of the down tube 31, the inside surface of the upper diffuser down tube 47, and the inside surface of the lower diffuser down tube 50 define a media return conduit 43.

In operation, the diffuser 44 can receive recirculated fluid that has first moved through the dispense head 24 and then through a plurality of annular recirculation conduits 69 (FIG. 4) included in the drum insert 22 that communicate fluidly with the dispense head 24. Prior to reaching the diffuser down tubes 47, 50, the foam reduction chamber 48 can separate gas from the foam. This can be accomplished by the walls of the foam reduction chamber 48 (wall portion 45 and funnel portion 46) breaking up the foam and reducing the foam to separate gas and recirculated fluid. Once the foam has been reduced, the gas removed from the recirculated fluid can be discharged through vents that are connected to the venting port 65 of the dispense head 24. While this occurs, the liquid portion of the recirculated fluid can generally flow downwardly in a settled, substantially laminar-type flow and into the diffuser down tubes 47, 50. After traveling through the foam reduction chamber 48 and into the diffuser down tube portions 47, 50, the velocity of the recirculated fluid can be reduced and the fluid discharged into the drum.

Referring to FIGS. 2, 3, and 5, the diffuser 44 can further comprise one or more deflectors 51 positioned at an end of the lower diffuser down tube 50. The lower diffuser down tube 50 can be welded to the upper diffuser down tube 47 and to the down tube 31 by known methodologies, such as described in U.S. Pat. No. 4,929,293, which is incorporated herein by reference in its entirety.

The deflector 51 is depicted as a peripheral flange and can scatter the dispensed recirculated fluid outwardly and generally laterally to provide better recirculation and reduce the formation of foam as the recirculated fluid is introduced into the drum 20. The deflector 51 can be positioned such that the recirculated fluid is returned to the drum 20 through the media return conduit 43 and out of the deflector 51 or an exiting portion of the down tube 31 below or above the liquid level in the drum, thus inhibiting the foaming of the recirculated fluid as it is reintroduced into the drum 20. As a result, the diffuser 44 can inhibit turbulent flow of the fluid, which can be present in conventional system as fluid is discharged directly into a drum and into the top level of the fluid in the drum 20. The deflector 51 can be positioned at any point along the down tube 31.

Figure 6:
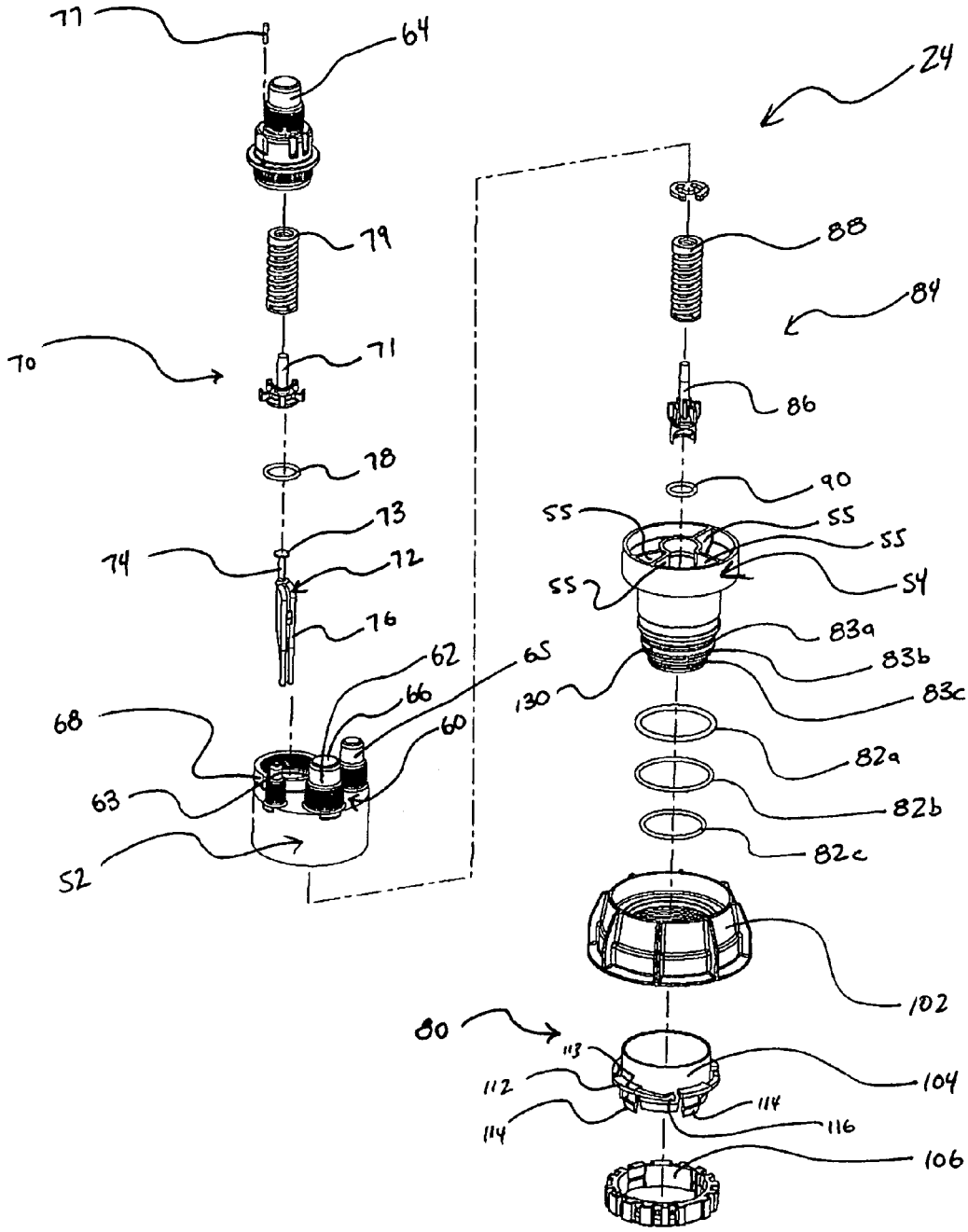
FIG. 6 is an exploded view of a dispense head and coupling assembly of the present invention.
Figure 7:
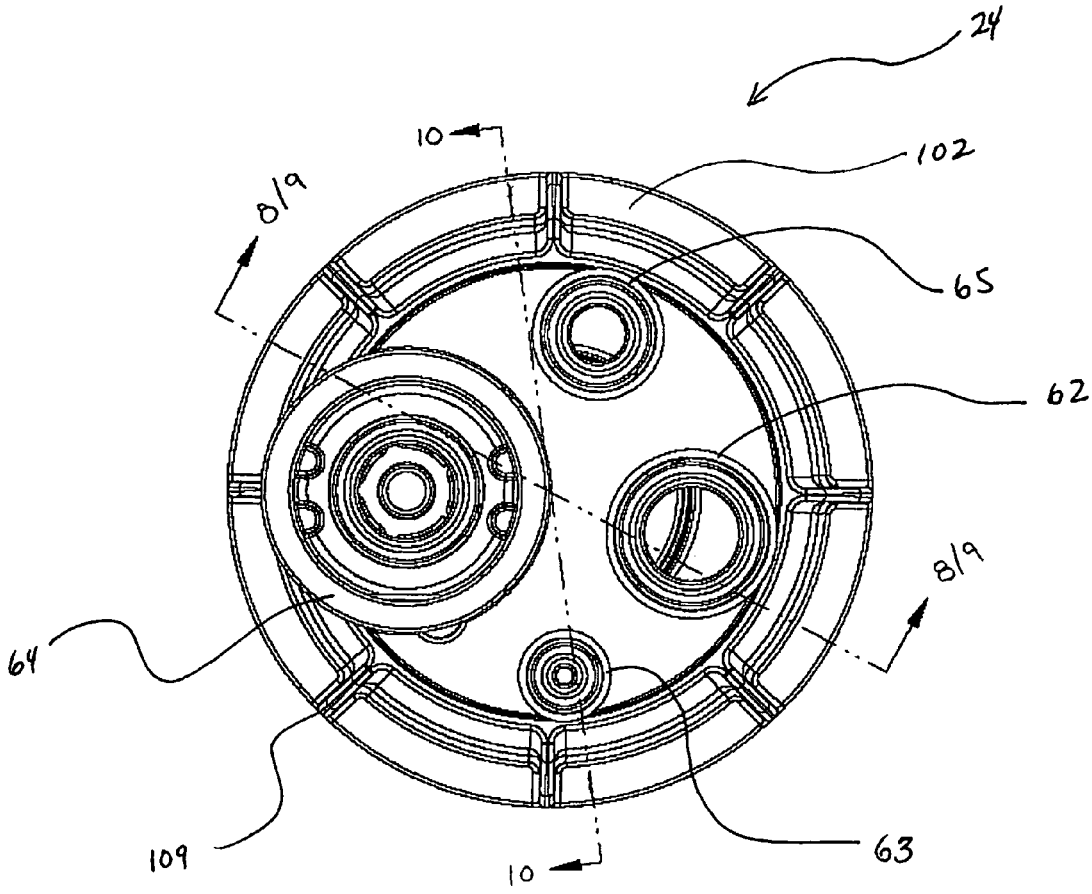
FIG. 7 is a top plan view of the dispense head of FIG. 6.

Referring to FIG. 6, the dispense head 24 generally includes an upper body section 52 and a lower body section 54 coupled thereto. The upper body section 52 can be welded to the lower body section 54 methodologies known to those skilled in the art, such as those disclosed in U.S. Pat. No. 4,929,293, which is incorporated herein by reference in its entirety. Alternatively, the upper body section 52 and lower body section 54 can be operably coupled or integrally formed. A plurality of fittings 60 can be positioned at the top of the upper section 52 and can utilize conventional connections such as Flaretek® connections for attachment of tubing, such as PFA tubing, to the dispense head 24. In one embodiment, such as those depicted in the figures, the fittings are threaded. In general, the fittings 60 define at least a main fluid port 62 and a recirculation port 64.

The ports 62, 64 can provide connection to a main fluid conduit 66 and main recirculation conduit 68, respectively, and both conduits 66, 68 can run from the upper body section 52 to the lower body section 54. In addition, other ports and conduits for venting 65 and seal verification 63 can be implemented and employed in the dispense head 24.

The recirculation port 64 can be connected to the recirculation conduit 66 with corresponding threaded sections on the port 64 and conduit 68. By having multiple ports in a single dispense head 24, extra bungs 21 on a drum 20 can be freed for other uses, such as including a mixer on an additional bung that can be used to mix various slurries within the drum to inhibit settling of the solids in the drum.

The lower body section 54 of the dispense head 24 can include a plurality of O-rings 82*a*, 82*b*, and 82*c* and a main valve assembly 84. As depicted in FIGS. 6 and 12, the O-rings 82 can be retained in a plurality of O-ring seats 83 on the dispense head 24 rather than within the drum insert 22. This can reduce manufacturing costs and increase ease of assembly and disassembly. The lower body section 54 of the dispense head 24 can include three O-rings 82*a*, 82*b*, and 82*c*, which are retained, respectively, in O-ring seats 83*a*, 83*b*, and 83*c*. O-rings 82*a*, 82*b*, and 82*c* can be Teflon® encapsulated, although those skilled in the art will recognize that other materials and coatings can be used.

Figure 10:
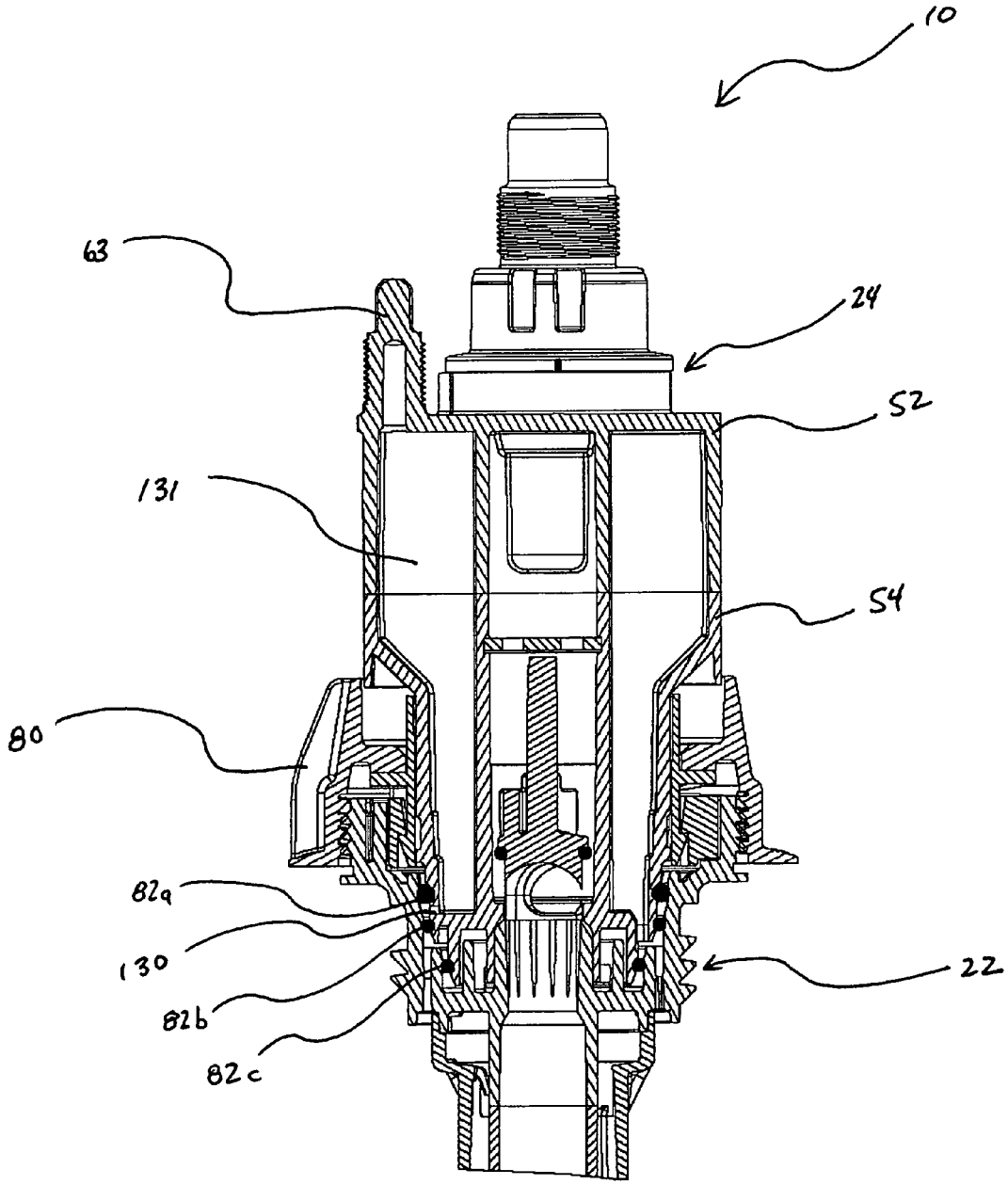
FIG. 10 is an elevational view of the dispense head of FIG. 7 taken along line 10-10 operably coupled with the drum insert of FIG. 2, depicting a cross-sectional view of the seal verification conduit.

Referring to FIG. 10, included on the lower body section 54 intermediate two O-rings (O-rings 83*a* and 83*b* as depicted in FIGS. 6 and 10) is a verification aperture 130, which can be used in conjunction with the seal verification port 63 to verify that there is a sufficient seal between the dispense head 24 and drum insert 22, as will be described in greater detail herein.

Referring to FIG. 6, the lower body section 54 of the dispense head 24 can further include a plurality of partitions 55 dividing the lower body section 54 into separate sections corresponding to each of the fittings included on the dispense head, such as main fluid port 62, recirculation port 64, seal verification port 63, and venting port 65.

Referring to FIGS. 8 and 9, the main valve assembly 84 can be positioned and operably retained within the main fluid conduit 66 of the upper body section 52. The valve assembly 84 generally includes a poppet 86, engagement portion 87, a spring 88, and an O-ring 90. In one embodiment, the poppet 86, engagement portion 87, and spring 88 are constructed of PFA, and O-rings 82, 90 are constructed of Kalrez®, although those skilled in the art will recognize that other materials can be used.

Referring to FIG. 8, when the dispense head 24 and drum insert 22 are not operably coupled, the spring 88 biases poppet 86 toward a closed position to inhibit fluid flow through the main fluid conduit 66. The poppet 86 further includes an engagement portion 87 that engages nubs, protrusions or other members/portions of the drum insert 22 to raise the poppet 86 from its closed seat position to enable fluid flow through the main fluid conduit 66. Various poppet assemblies and sealing methodologies can be employed with the present invention, such as that described in U.S. Patent Publication No. 2003/0010387, which is incorporated herein by reference in its entirety.

Referring again to FIGS. 8 and 9, in operation, poppet 86 depresses into an open position when the dispense head 24 is attached to the drum insert 22. The main valve assembly closes when the dispense head 24 is removed from the drum insert 22 and thus inhibits fluid in the dispense head 24 and main tubing line from spilling out when the dispense head 24 is removed.

Referring to FIG. 6, a recirculation valve assembly 70 can be positioned and operably retained within the main recirculation conduit 68 on the upper body section 52 of the dispense head 24. However, the valve assembly 70 can be disposed anywhere along the recirculation conduit 68. The recirculation port 64 can be retained within the main recirculation conduit 68 by threads and inhibited from rotation by a pin 77 fitting within an aperture located proximate the main recirculation conduit 68 on the upper body section 52.

Referring to FIG. 6, the recirculation poppet assembly 70 generally includes a poppet 71, a poppet stem 72, a seat 73, an O-ring 78 and a spring 79. In one embodiment, O-rings 78 are constructed of Kalrez®, although other materials can be used without departing from the scope of the present invention. The poppet stem 72 can be operably connected to the poppet 72 and further includes a stem upper section 74 and a forked stem lower section 76. Various poppet assemblies and sealing methodologies can be employed as a recirculation valve assembly 70 with the present invention.

Referring to FIGS. 8 and 9, in operation, recirculation valve assembly 70 automatically cuts off the flow in the main recirculation conduit 68 when the dispense head 24 is removed from the drum insert 22. In the closed position, as can be seen in FIG. 8, the poppet 71 and O-ring 78 are biased toward the seat 73 by the spring 79 to inhibit fluid flow through the conduit 68. In the open position, as can be seen in FIG. 9, upon operable engagement of the dispense head 24 with the drum insert 22, the lower section 76 of the stem 72 engages the actuation rib 37 of the drum insert 22 such that the entire stem 72 can be forced upwardly to disengage the poppet 71 and O-ring 78 from the seat 73. As a result, the main recirculation conduit 68 can be opened proximate the poppet assembly 70 and fluid flow through the conduit 68 is permitted. Upon disengagement of the dispense head 24 from the drum insert 22, the lower stem section 76 retreats from the rib 37 and the bias of the spring 79 forces the poppet 71 and O-ring into the closed position against the seat 73 to again stop fluid flow through the conduit 68. While the main valve assembly 84 and recirculation valve assembly 70 have been described and depicted as poppet valves, other various valves, such as a ball valve, and the like, can be used with the fluid dispense system 10 as well.

Figure 11:
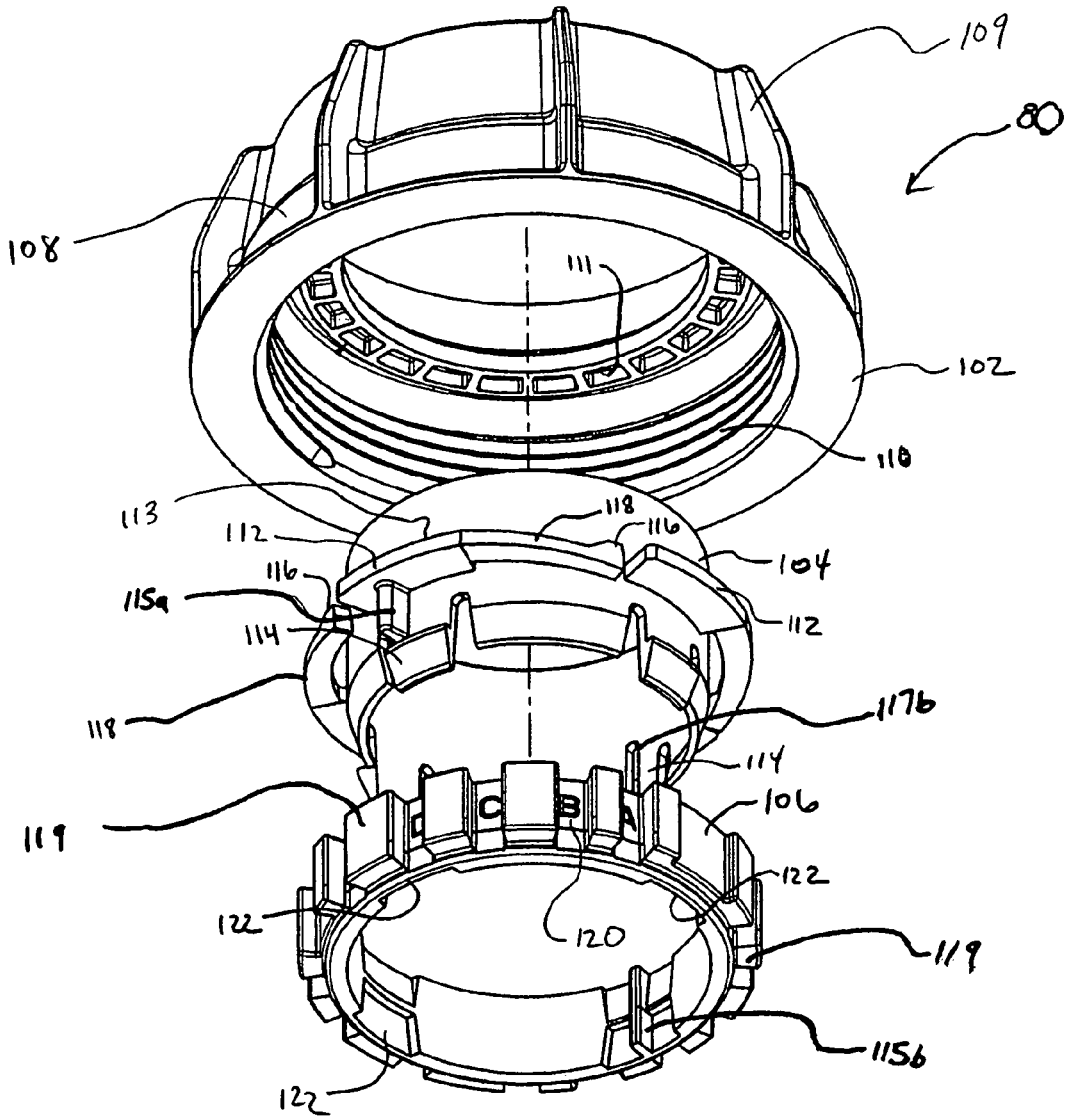
FIG. 11 is an exploded view of the coupling assembly of FIG. 6.

Referring to FIGS. 6 and 11, the dispense head 24 also can include a coupling assembly 80 or clutch mechanism that can be used to connect the dispense head 24 to the drum insert 22. The coupling assembly 80 generally includes a clutch or retaining ring 102, a spring collar 104 operably connected to the retaining ring 102, and a key code ring 106 engageable with the spring collar 104. While in one embodiment the coupling assembly 80 can be constructed of high-density polyethylene, those skilled in the art will recognize that other materials can be used.

The retaining ring 102 of the coupling assembly 80 includes a body portion 108, a threaded portion 110, and a plurality of interior drive apertures or detents 111 that are spaced on an interior surface of the retaining ring 102. In one embodiment, the body portion 108 also can include a plurality of gripping members 109 on an exterior surface of the retaining ring 102 to enable ease of gripping and rotating the coupling assembly 80.

The spring collar 104 of the coupling assembly 80 includes a retaining ring flange 112 having a flange surface 113, a plurality of snap members 114, and a plurality of drive lugs 116 having spring fingers 118. The spring collar 104 can be operably connected to the retaining ring 102 such that the retaining ring 102 spins freely on the retaining ring flange 112 when the dispense head 24 is not connected to the drum insert 22.

The key code ring 106 of the coupling assembly 80 includes a plurality of key sections 119. Examples of key code rings can be seen in U.S. Pat. No. 5,108,015, which is hereby incorporated by reference in its entirety. The key code ring 106 of the coupling assembly 80 in the various embodiments of the present invention can further include a plurality of snap receiving notches 122 spaced to correspond with the snap members 114 on the spring collar 104, and indicia 120 located on or intermediate the key sections 119. The key code ring 104 can be connected to the spring collar 104 by slidably engaging the key code ring 106 with the spring collar 104 until the snap members 114 engage the snap receiving notches 122.

To inhibit the key code ring 106 from rotating with respect to the spring collar 104, the key code ring 106 and spring collar 104 are provided with retaining tabs 115 and retaining grooves 117. A first retaining tab 115*a* can be provided on the spring collar 104 and corresponds with a first retaining groove 117*a* on the key code ring 106. A second retaining tab 115*b* can be provided on the key code ring 106 and corresponds with a second retaining groove 117*b* on the spring collar 104. The retaining tabs 115 engage the retaining grooves 117 when the key code ring 106 is connected to the spring collar 104, thus inhibiting the key code ring 106 from rotating with respect to the spring collar 104.

The retaining ring 102 and spring collar 104 are operably engaged or attached prior to coupling the dispense head 24 to the drum insert 22. In this position, the retaining ring 102 can spin freely on the retaining ring flange 112 of the retaining ring 102, and therefore the retaining ring 102 can spin freely with respect to the key code ring 106. In this position, the drive lugs 116 are below the flange surface 113 and therefore not engageable with the interior drive detents 111.

The coupling assembly 80 enables much easier connection of a coded dispense head 24 to a coded drum insert 22 than required by prior systems. To assemble the fluid dispense system 10, the dispense head 24, including the coupling assembly 80, can be first placed onto the drum insert 22. As the coupling assembly 80 is pushed downwardly, the key code ring 106 abuts against a top portion of the insert 72, causing the key code ring 106 to push on the spring fingers 118 so that the drive lugs 116 are forced above the flange surface 113. In this position, the drive lugs 116 are then engageable with the interior drive detents 111. When the drive lugs 116 engage with the interior drive detents 111, the drive lugs 116 inhibit the retaining ring 102 from spinning freely with respect to the key code ring 106 when the retaining ring 102 is rotated in a clockwise motion. Therefore, by rotating the retaining ring 102 in a clockwise motion, one can control the rotation of the key code ring 106 to align the key code ring 106 into alignment with a matching coded drum insert 22.

Once the key code ring 106 is rotated into alignment with a matching coded drum insert 22, the spring fingers 118 drive the key code ring 106 into the matching coded drum insert 22, causing the key code ring 106 to fall into position in the drum insert 22. In this position, the spring fingers 118 are relaxed and the drive lugs 116 fall below the flange surface 113 and thus out of reach of the interior drive detents 111, such that the retaining ring 102 can again spin freely on the retaining ring flange 112. By continuing to rotate the retaining ring 102 in a clockwise motion, the threaded portion 110 of the retaining ring 102 mates with the cap thread portion 32 of the upper portion 26 of the drum insert 22. This threading action continues to pull the dispense head 24 into the drum insert 22 to complete the sealing connection of the dispense head 24 to the drum insert 22.

Referring to FIGS. 6 and 10, a seal verification port 63 can be implemented and employed in the dispense head 24. In an embodiment of the dispense head 24 including a seal verification port 63, a verification aperture 130 can be included on the lower body section 54 intermediate two adjacent O-rings 82 in the O-ring assembly. As depicted in FIGS. 6 and 10, the verification aperture can be located intermediate upper O-ring 82*a* and middle O-ring 82*b* in the O-ring assembly. As can best be seen in FIG. 10, the verification aperture 130 can communicate with the seal verification port through a seal verification conduit 131 or channel or series of channels.

In order to verify that there is an adequate seal between the dispense head 24 and drum insert 22, air (such as compressed air) can be forced into the seal verification port 63. If there is a drop in pressure greater than a predetermined amount, this indicates that there is not an adequate seal between O-rings 82*a*, 82*b*, and thus between the dispense head 24 and drum insert 22, and adequate remedial measures must generally be taken to ensure that there is a proper seal. Otherwise, the seal is sufficient and dispensing of liquids from the drum is possible.

Referring to FIG. 2, the fluid dispense system 10 according to the present invention can include a cap assembly 132 that can be used when transporting or storing a drum 20. The cap assembly 132 generally includes a cap 134, a cap attachment portion 136, and an O-ring 142. The cap attachment portion 136 can be connected to the cap 136 by inserting a plurality of cap snap members 138 included on the cap attachment portion 136 into the cap 134. The cap 134 and cap attachment portion 136 can then be connected to the drum insert 22 by rotating the cap 134 such that a threaded internal portion of the cap 134 engages with cap thread portion 32 included on the drum insert 22. When fully engaged with the drum insert 22, the cap 134 and O-ring 142 create a seal so that the fluids contained in the drum 20 cannot escape. Other caps can be employed as well without departing from the scope of the present invention.

The invention has been described above with reference to several embodiments thereof. It will be apparent to those skilled in the art that alterations may be made in the embodiments described without departing from the scope of the invention. Thus, the scope of the present invention should not be limited by the embodiments described herein, but rather by the language of the claims and the equivalents of those structures.

What is claimed is:

1. A fluid dispense system for use with a drum containing liquid that is caustic or high purity, and for dispensing the liquid and recirculating the liquid dispensed, the system comprising:

a polymer drum insert configured to operably couple with a bung included on a drum, the drum insert constructed from a fluoropolymer, the drum insert having an upper portion with a drum engaging portion, a drum insert down tube centrally positioned in the upper portion and extending therefrom into an interior of the drum, an upwardly extending nipple communicatively connected to the downtube, a support structure extending from the drum engaging portion to the nipple, the support structure having an intermediate conduit between the dispense head and drum;

a dispense head comprising a fluoropolymer configured to operably couple with the drum insert and the drum, the dispense head having a first dispense conduit for dispensing the fluid and comprising a first valve assembly and a second fluid recirculation conduit comprising a second valve assembly, each of the first and second valve assemblies being in operable engagement and communication with the drum insert when the dispense head is operably coupled with the drum insert, such that the first and second valve assemblies are effected to an open position enabling the liquid to flow through the conduits, and when the dispense head is not operably coupled with the drum insert the first and second valve assemblies are biased to a closed position inhibiting the liquid from flowing through the conduits, wherein:

the first valve assembly movable along a first vertical axis of operation between the open and the closed position and the second valve assembly includes a poppet, the poppet being movable along a second vertical axis of operation between the open position and the closed position, the first vertical axis of operation and the second vertical axis of operation being parallel and non-co-axial with respect to each other;

the first valve assembly of the dispense head includes a flow-inhibiting member having an engagement portion and a first biasing member that biases the flow-inhibiting member to the closed position when the dispense head is not operably coupled to the drum insert, and wherein the engagement portion is adapted to engage the nipple of the drum insert when the dispense head is operably coupled with the drum insert such that the flow-inhibiting member is forced upwardly with respect to the dispense head thereby effecting the first valve assembly to the open position;

the second valve assembly of the dispense head further includes a downwardly extending stem portion engaged with the poppet, and a second biasing member that biases the poppet to the closed position when the dispense head is not operably coupled to the drum insert thereby inhibiting spillage, and wherein the stem portion is adapted to engage the drum insert at the support structure extending between the drum engagement portion of the drum insert and the nipple when the dispense head is operably coupled with the drum insert such that the stem portion is forced upwardly with respect to the dispense head to effect the second valve assembly to the open position by overcoming the second biasing member to move to the open position; and the flow-inhibiting member is located at a first distance from the drum insert along the first vertical axis when in the open position, the poppet is located at a second distance from the drum insert along the second vertical axis when in the open position, the second distance being unequal to the first distance;

whereby the flow in the dispense conduit and recirculation conduit are independently and automatically cut off when the dispense head is removed from the drum inhibiting spillage resulting from said removal;

the system further comprises a cap assembly selectively connectable to a cap thread portion on the upper portion of the drum insert to selectively seal the drum during transport or storage of the drum when the dispense head is not coupled with the drum insert.

2. The system of claim 1, wherein the stem portion comprises an upper section and a lower section, with the lower section being offset from the upper section.

3. The system of claim 1, wherein the dispense head further comprises a body portion with a plurality of ports including a port connecting to the first conduit, a port connecting to the second conduit, a port connecting to a venting conduit, and a port connecting to a seal verification conduit.

4. The system of claim 3, wherein the drum insert comprises an actuation rib effecting the poppet valve to the open position when the dispense head is operably coupled with the drum insert.

5. The system of claim 1, wherein the second conduit comprises a recirculation fluid conduit enabling fluid to be returned to the interior of the drum through the recirculation fluid conduit.

6. The system of claim 5, wherein the first fluid conduit comprises a main fluid conduit in fluid communication with a tube conduit included in the drum insert down tube and the recirculation fluid conduit is in fluid communication with a media return conduit defined by the drum insert down tube and a diffuser down tube, the diffuser down tube further comprising a deflector proximate a lower end thereof.

7. The system of claim 5, further comprising a foaming reduction member to reduce foaming of recirculated fluid prior to returning to the drum through the recirculation fluid conduit.

8. The system of claim 7, wherein the foaming reduction member comprises a foam reduction chamber such that gas is separated from the recirculated fluid and the gas is vented from the chamber and the fluid flows out of the chamber and through the media return conduit.

9. The system of claim 1, wherein the dispense head further comprises a vent conduit enabling gas to enter and leave the drum through the vent conduit.

10. The system of claim 1, wherein the dispense head further comprises a seal verification conduit in fluid communication with an aperture intermediate two seals at a junction between the operably coupled dispense head and drum insert.

11. A method of using a fluid dispense system for use with a drum containing a caustic or high purity liquid and having a dispense conduit and a liquid recirculation conduit and for reducing spillage from the recirculation conduit when a dispense head is disconnected, the method comprising:

inserting a drum insert into an access opening of a drum such that a drum insert down tube of the drum insert extends into an interior of the drum into said fluid and such that a nipple is outwardly exposed, the nipple supported by support structure extending from a drum engaging portion to the nipple, the support structure having an intermediate conduit between the dispense head and drum;

operably coupling the drum engaging portion of an upper portion of the drum insert with the drum at the access opening of the drum;

providing a dispense head comprising a fluoropolymer having a first dispense conduit comprising a first valve assembly and a second recirculation conduit comprising a second valve assembly, wherein the first valve assembly is movable along a first vertical axis of operation and the second valve assembly is movable along a second vertical axis of operation, the first vertical axis of operation and the second vertical axis of operation being parallel to each other and laterally offset with respect to each other;

operably coupling the dispense head to the drum insert such that the first valve assembly engages the nipple, the second valve assembly engages the support structure extending from the drum engaging portion to the nipple, and the first and second valve assemblies are effected into an open position enabling the liquid to flow through the respective first and second conduits;

directing the liquid out of the drum via the first dispense conduit when the first valve assembly is in the open position; returning the liquid to the drum via the second recirculation conduit to recirculate the liquid when the second valve assembly is in the open position; and operably decoupling the dispense head from the drum insert, the decoupling causing the first and second valve assemblies to close by way of the decoupling and thereby inhibiting the liquid in the first dispense, conduit and the second recirculation conduit from exiting the dispense head when decoupled, thereby reducing spillage.

12. The method of claim 11, further comprising:

providing a foaming reduction member within the drum insert, the foam reduction member having a foam reduction chamber, such that gas is separated from the recirculated liquid in the foam reduction chamber; and venting the gas from the foam reduction chamber and enabling the liquid to flow out of the foam reduction chamber to an interior of the drum.

13. The method of claim 11, further comprising providing a vent conduit on the dispense head and enabling gas to enter and leave the drum through the vent conduit.

14. The method of claim 11, further comprising providing a seal verification conduit on the dispense head, the seal verification conduit in fluid communication with an aperture intermediate two seals positioned at a junction between the dispense head and the drum insert, such that the seal verification conduit can be used to verify an integrity of the seals.

15. The method of claim 14, further comprising placing the seals onto seal seats located on the dispense head.

16. A fluid dispense system for use with a drum to minimize spillage when a dispense head is removed, the system comprising:

a polymer drum insert configured to couple an access opening of a drum, the drum insert having an upper portion and a drum insert down tube extending therefrom into an interior of the drum; and a dispense head comprising fluoropolymer operably coupled to the drum and the drum insert, the dispense head having a first fluid dispense conduit comprising a first valve member and a second fluid recirculation conduit comprising a second valve member, the first and second valve members in communication with the drum insert when the dispense head is operably engaged and coupled with the drum insert, such that the first and second valve members are in an open position enabling fluid to flow through the conduits, and when the dispense head is not operably coupled with the drum insert the first and second valve members are biased to a closed position inhibiting fluid from flowing through the conduits whereby liquid from the recirculation conduit is stopped from escaping, wherein:

the first valve assembly comprises a first valve member movable along a first vertical axis of operation between the open position and the closed position and centrally located over the drum insert and the second valve assembly comprises a second valve member movable along a second vertical axis of operation between the open position and the closed position, the first vertical axis of operation and the second vertical axis of operation being parallel to each other and not coaxial with respect to each other;

the first valve member of the dispense head includes a first flow-inhibiting member having an engagement portion and a first biasing member that biases the first flow-inhibiting member to the closed position when the dispense head is not operably coupled to the drum insert, and wherein the engagement portion is adapted to engage the drum insert when the dispense head is operably coupled with the drum insert such that the first flow-inhibiting member is forced upwardly with respect to the dispense head to effect the first flow-inhibiting member to the open position;

the second valve assembly of the dispense head includes an actuation member, a second flow-inhibiting member and a second biasing member that biases the second flow-inhibiting member to the closed position when the dispense head is not operably coupled to the drum insert whereby spillage of the fluid in the fluid dispense conduit and fluid in the return conduit is reduced, and wherein the actuation member is adapted to engage the drum insert when the dispense head is operably coupled with the drum insert such that the actuation member is forced upwardly with respect to the dispense head to effect the second valve member to the open position by overcoming the second biasing member to move the second flow-inhibiting member to the open position; and one of the first flow-inhibiting member and the second flow-inhibiting member is positioned at least partially within the dispense head when in the open position, and the other of the first flow-inhibiting member and the second flow-inhibiting member is positioned outside the dispense head when in the open position.

17. The system of claim 16, wherein the second valve assembly is a poppet valve and the second flow-inhibiting member is a poppet.

18. The dispense head of claim 16, wherein the first fluid conduit is a main fluid conduit in fluid communication with a tube conduit included in the drum insert down tube and the recirculation fluid conduit is in fluid communication with a media return conduit defined by the drum insert down tube and a diffuser down tube, the diffuser down tube further comprising deflect or at a lower end thereof.

19. The system of claim 16, wherein the dispense head further comprises venting enabling gas to enter and leave the drum through a vent conduit.

20. The system of claim 16, wherein the dispense head further comprises a seal verification port in fluid communication with an aperture intermediate two seals at a junction between the operably coupled dispense head and the drum insert.

21. The system of claim 1 wherein the dispense head further comprises a seal verification port in fluid communication with a seal verification conduit and an aperture intermediate two seals at a junction between the dispense head and the drum insert, the aperture being substantially transverse the seal verification conduit, such that an integrity of a sealing between the dispense head and drum insert can be verified by forcing air into the seal verification port.

22. The fluid system of claim 21, wherein the two seals are O-rings encapsulated with polytetrafluoroethylene (PTFE).

* * * * *